US011721475B2

(12) United States Patent
Ryu et al.

(10) Patent No.: US 11,721,475 B2
(45) Date of Patent: Aug. 8, 2023

(54) COIL COMPONENT

(71) Applicant: SAMSUNG ELECTRO-MECHANICS CO., LTD., Suwon-si (KR)

(72) Inventors: Joung Gul Ryu, Suwon-si (KR); Ju Hwan Yang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 742 days.

(21) Appl. No.: 16/668,611

(22) Filed: Oct. 30, 2019

(65) Prior Publication Data

US 2021/0050140 A1 Feb. 18, 2021

(30) Foreign Application Priority Data

Aug. 12, 2019 (KR) ..... KR10-2019-0098099

(51) Int. Cl.
*H01F 27/28* (2006.01)
*H01F 27/29* (2006.01)

(52) U.S. Cl.
CPC ..... *H01F 27/2804* (2013.01); *H01F 27/29* (2013.01)

(58) Field of Classification Search
CPC ..... H01F 17/0013; H01F 27/2804; H01F 2027/2809; H01F 17/0006; H01F 5/003; H01F 27/29; H01F 27/292
USPC ..... 336/200, 232
See application file for complete search history.

(56) References Cited

U.S. PATENT DOCUMENTS

2016/0141102 A1* 5/2016 Tseng ..... H01F 27/292 336/200
2018/0286561 A1 10/2018 Shimochi
2018/0342341 A1* 11/2018 Aoki ..... H01G 4/30
2019/0096564 A1 3/2019 Park et al.

FOREIGN PATENT DOCUMENTS

JP 2018-174306 A 11/2018
JP 2018198269 A * 12/2018
KR 2018012621 A * 2/2018 ..... H01F 17/0013
KR 10-2019-0035435 A 4/2019

* cited by examiner

*Primary Examiner* — Tszfung J Chan
(74) *Attorney, Agent, or Firm* — Morgan, Lewis & Bockius LLP

(57) ABSTRACT

A coil component includes a body; a support substrate embedded in the body; and a coil portion disposed on the support substrate and embedded in the body, and including a lead-out pattern disposed on one surface of the support substrate, and an auxiliary lead-out pattern disposed on the other surface of the support substrate and corresponding to the lead-out pattern. The auxiliary lead-out pattern includes an external surface exposed from a surface of the body and an internal surface opposing the external surface, and the body includes an anchor portion disposed inside the auxiliary lead-out pattern.

18 Claims, 20 Drawing Sheets

COIL COMPONENT

CROSS-REFERENCE TO RELATED APPLICATION(S)

This application claims benefit of priority to Korean Patent Application No. 10-2019-0098099 filed on Aug. 12, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in electronic devices, together with a resistor and a capacitor.

As electronic devices become more and more efficient and smaller, coil components used for electronic devices have increased in number and become smaller.

In a case of a conventional thin film inductor, since a body includes a metal powder particle as a conductor, an insulating film may be interposed between a coil and the body for electrical insulation between the coil and the body.

Meanwhile, as a relative area occupied by a lead-out pattern of the coil in the body increases, bonding force between the lead-out pattern and the body may be deteriorated by the above-mentioned insulating film.

SUMMARY

An aspect of the present disclosure is to provide a coil component having improved reliability of bonding by enhancing adhesion between a coil portion and a body.

Another aspect of the present disclosure is to provide a coil component having improved characteristics by increasing an area occupied by a body in the coil component.

According to an aspect of the present disclosure, a coil component includes a body; a support substrate embedded in the body; and a coil portion disposed on the support substrate and embedded in the body, and including a lead-out pattern disposed on one surface of the support substrate, and an auxiliary lead-out pattern disposed on the other surface of the support substrate and corresponding to the lead-out pattern. The auxiliary lead-out pattern includes an external surface exposed from a surface of the body and an internal surface opposing the external surface, and the body includes an anchor portion disposed inside the auxiliary lead-out pattern.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
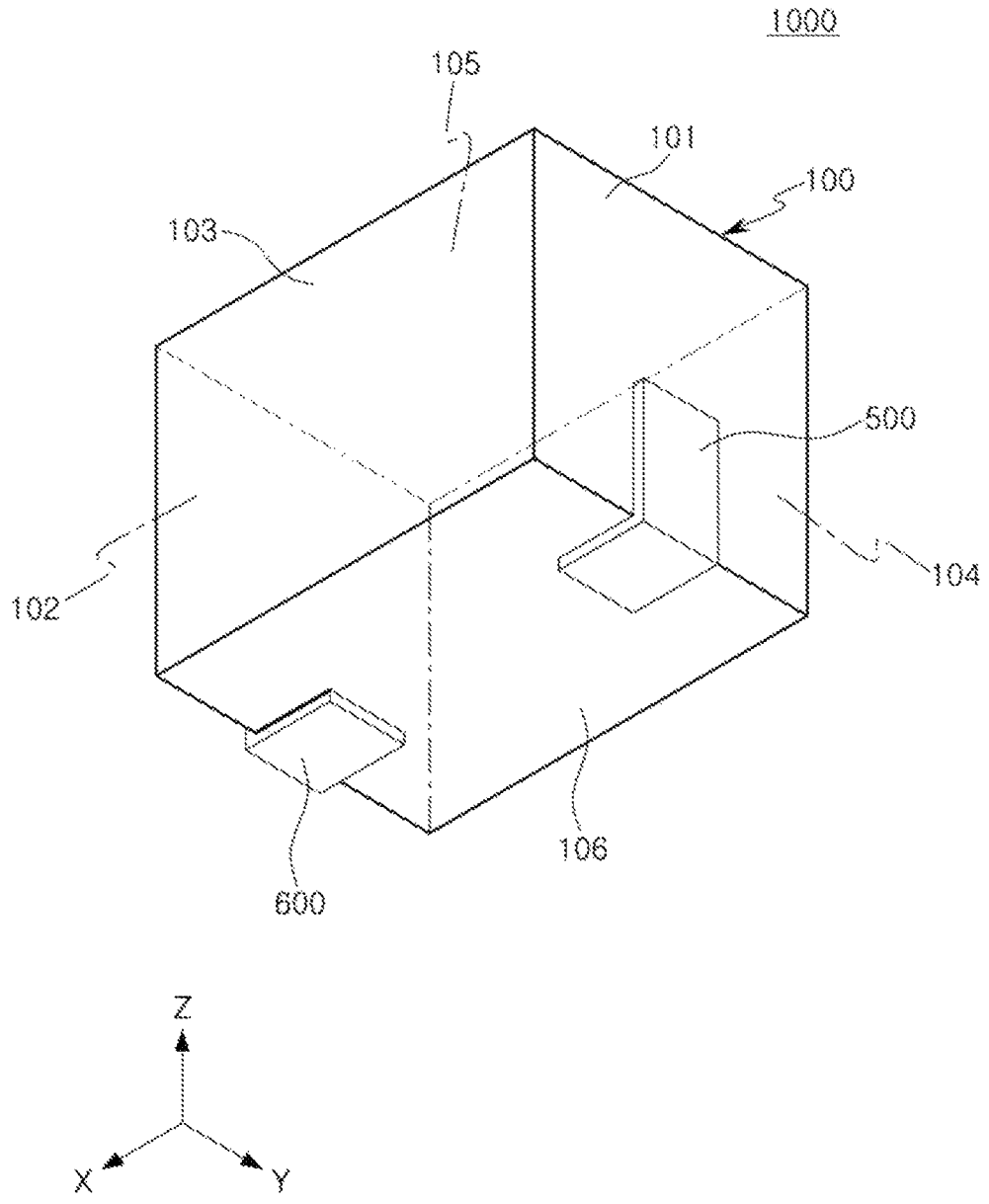
FIGS. 1 and 2 are views schematically illustrating a coil component according to a first embodiment of the present disclosure, when viewed from a lower portion, respectively.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
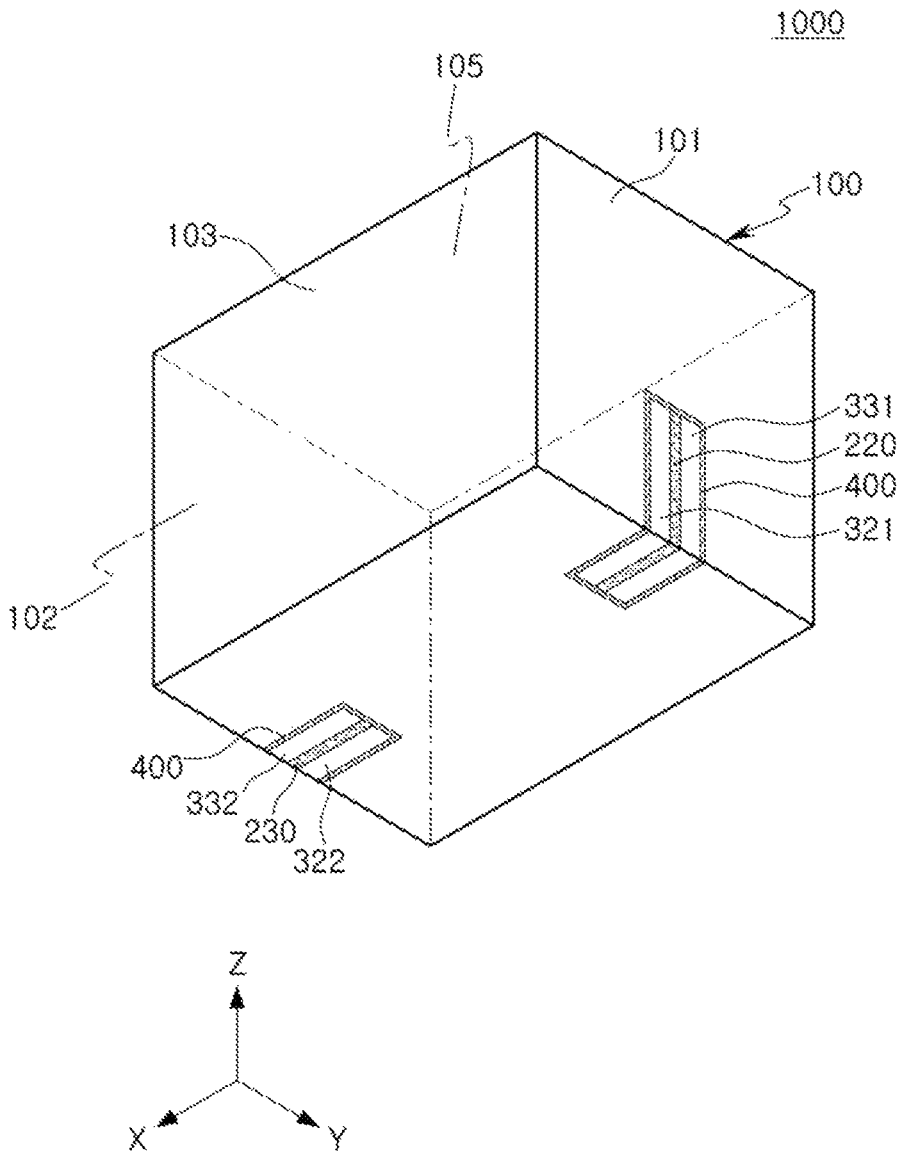
Figure 4:
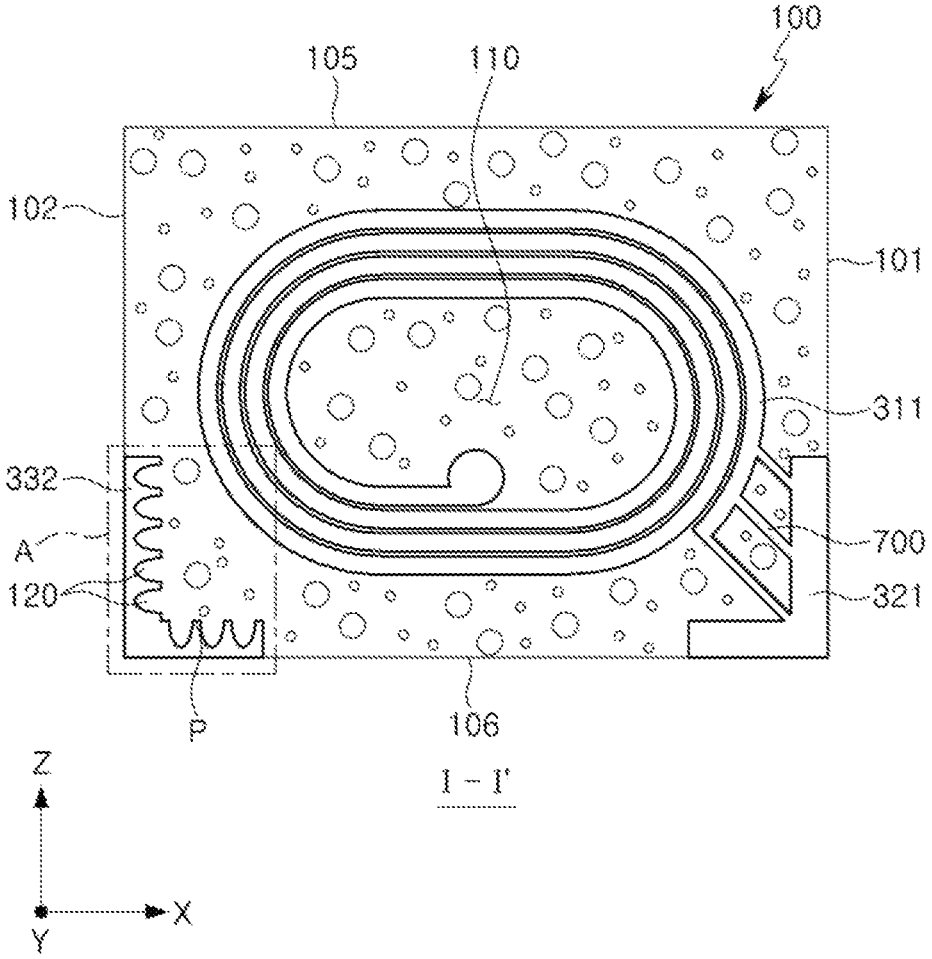
FIG. 4 is a view schematically illustrating a cross-sectional view taken along line I-I' of FIG. 3.
Figure 5:
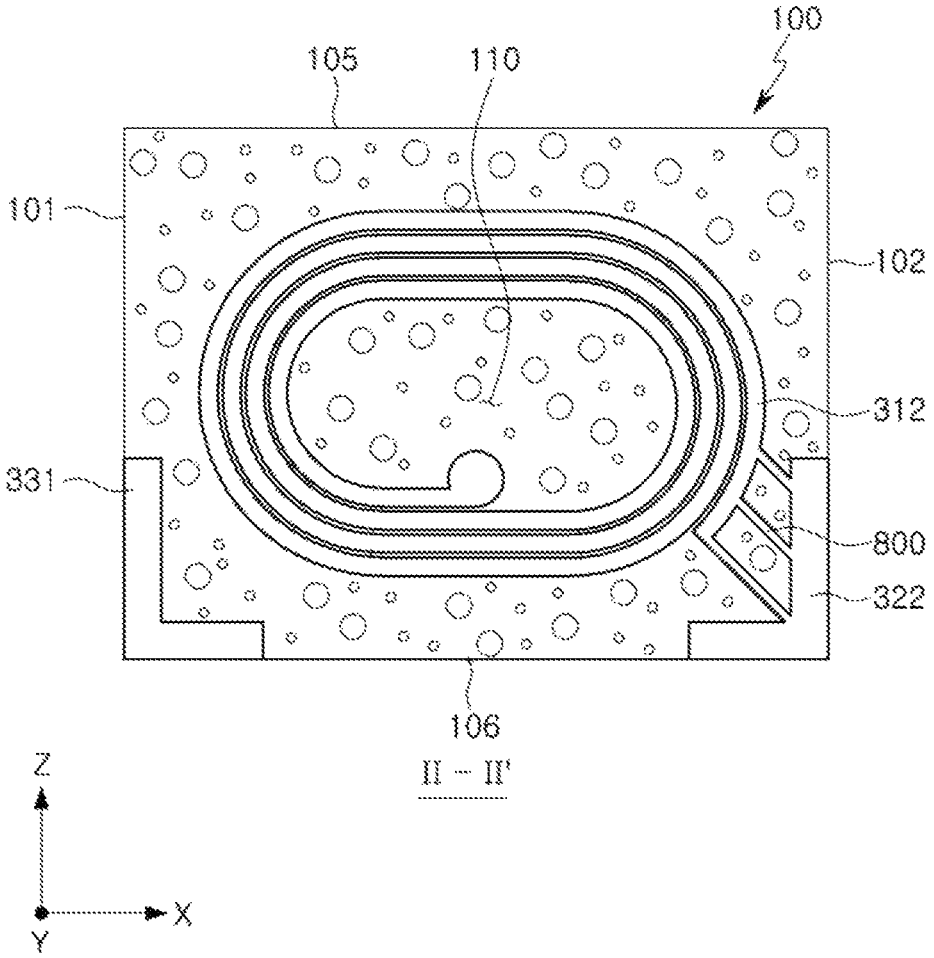
FIG. 5 is a view schematically illustrating a cross-sectional view taken along line II-II' of FIG. 3.
Figure 6:
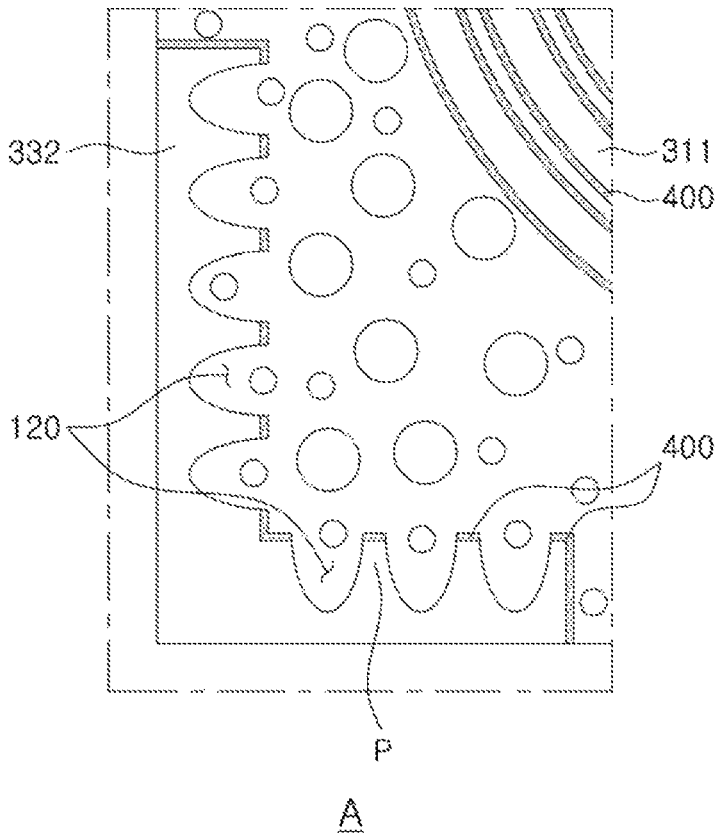
FIG. 6 is a view schematically illustrating an enlarged view of portion A of FIG. 4.

FIGS. 1 and 2 are views schematically illustrating a coil component according to a first embodiment of the present disclosure, when viewed from a lower portion, respectively. FIG. is a view schematically illustrating a coil component according to a first embodiment of the present disclosure, when viewed from a side direction. FIG. 4 is a view schematically illustrating a cross-sectional view taken along line I-I' of FIG. 3. FIG. 5 is a view schematically illustrating a cross-sectional view taken along line II-II' of FIG. 3. FIG. 6 is a view schematically illustrating an enlarged view of portion A of FIG. 4.

Referring to FIGS. 1 to 6, a coil component 1000 according to a first embodiment of the present disclosure may include a body 100, a support substrate 200, a coil portion 300, an insulating film 400, connecting conductors 700 and 800, and external electrodes 500 and 600. The support substrate 200 may include a support portion 210, and end portions 220 and 230. The coil portion 300 may include coil patterns 311 and 312, lead-out patterns 321 and 322, auxiliary lead-out patterns 331 and 332, and a via 340.

The body 100 may form an exterior of the coil component 1000 according to this embodiment, and may embed the coil portion 300 therein. The body 100 may include an anchor portion 120 inserted into each of the first and second auxiliary lead-out patterns 321 and 322 to be described later. This will be described later.

The body 100 may be formed to have a hexahedral shape overall, for example.

Referring to FIGS. 1 and 2, the body 100 may include a first surface 101 and a second surface 102 facing each other in a longitudinal direction X, a third surface 103 and a fourth surface 104 facing each other in a width direction Y, and a fifth surface 105 and a sixth surface 106 facing each other in a thickness direction Z. Each of the first to fourth surfaces 101, 102, 103, and 104 of the body 100 may correspond to wall surfaces of the body 100 connecting the fifth surface 105 and the sixth surface 106 of the body 100. Hereinafter, both side surfaces of the body 100 may refer to the first surface 101 and the second surface 102 of the body 100, and both end surfaces of the body 100 may refer to the third surface 103 and the fourth surface 104 of the body 100. Further, one surface and the other surface of the body 100 may refer to the sixth surface 106 and the fifth surface 105 of the body 100, respectively.

The body 100 may be formed such that the coil component 1000 according to this embodiment in which the external electrodes 500 and 600 to be described later are formed has a length of 1.0 mm, a width of 0.6 mm, and a thickness of 0.8 mm, but is not limited thereto. Since the numerical values described above may be merely design values that do not reflect process errors and the like, they should be considered to fall within the scope of the present disclosure to the extent in which ranges may be recognized as the process errors.

The body 100 may include a magnetic material and a resin. As a result, the body 100 may be magnetic. The body 100 may be formed by stacking one or more magnetic composite sheets including a resin and a magnetic material dispersed in the resin. However, the body 100 may have a structure other than the structure in which the magnetic material may be dispersed in the resin. For example, the body 100 may be made of a magnetic material such as ferrite.

The magnetic material may be a ferrite powder particle or a metal magnetic powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the metal magnetic powder particle may be a Fe—Si—B—Cr-based amorphous alloy powder particle, but is not limited thereto.

The ferrite powder particle and the metal magnetic powder particle may have an average diameter of about 0.1 μm to 30 μm, respectively, but are not limited thereto.

The body 100 may include two or more types of magnetic materials dispersed in the resin. In this case, the term "different types of magnetic materials" means that magnetic materials dispersed in a resin are distinguished from each other by at least one of an average diameter, a composition, a crystallinity, and a shape.

The resin may include an epoxy, a polyimide, a liquid crystal polymer, or the like, in a singular or combined form, but is not limited thereto.

The body 100 may include a core 110 passing through the coil portion 300 and the support substrate 200, to be described later. The core 110 may be formed by filling a through-hole of the coil portion 300 with the magnetic composite sheet, but is not limited thereto.

The support substrate 200 may be embedded in the body 100. Specifically, the support substrate 200 may be embedded in the body 100 to be perpendicular to the one surface 106 of the body 100. Therefore, the coil portion 300 disposed on the support substrate 200 may be disposed to be perpendicular to the one surface 106 of the body 100. The support substrate 200 may include the support portion 210, and the end portions 220 and 230. The support portion 210 may support first and second coil patterns 311 and 312 to be described later. The first end portion 220 may support a first lead-out pattern 321 and a first auxiliary lead-out pattern 331. The second end portion 230 may support a second lead-out pattern 322 and a second auxiliary lead-out pattern 332.

The support substrate 200 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) resin, a photoimageable dielectric (PID), a copper clad laminate (CCL), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide better rigidity. When the support substrate 200 is formed of an insulating material not containing glass fibers, the support substrate 200 may be advantageous for reducing a thickness of the overall coil portion 300, to reduce a width of the coil component 1000 according to this embodiment.

The coil portion 300 may be disposed on the support substrate 200. The coil portion 300 may be embedded in the body 100 to manifest the characteristics of the coil component. For example, when the coil component 1000 of this embodiment is used as a power inductor, the coil portion 300 may function to stabilize power supply of an electronic device by storing an electric field as a magnetic field and maintaining an output voltage. In this embodiment, for convenience of description, it can be understood that the lead-out pattern refers to a lead-out portion, and the auxiliary lead-out pattern refers to an auxiliary lead-out portion, respectively.

The coil portion 300 may be formed on at least one of opposite surfaces of the support substrate 200, and may form at least one turn. In this embodiment, the coil portion 300 may include the first and second coil patterns 311 and 312 respectively disposed on both surfaces of the support portion 210 opposing each other in the width direction Y of the body 100 and opposing each other, the first and second lead-out patterns 321 and 322 respectively disposed on both surfaces of the first end portion 220 and opposing each other, and the first and second auxiliary lead-out patterns 331 and 332 respectively disposed on both surfaces of the second end portion 230 and opposing each other. Also, the coil portion 300 may include the via 340 passing through the support portion 210 to connect the first and second coil patterns 311 and 312 to each other.

Each of the first coil pattern 311 and the second coil pattern 312 may have a planar spiral shape forming at least one turn with reference to the core 110. For example, based on the direction of FIG. 3, the first coil pattern 311 may form at least one turn with reference to the core 110 on the one surface of the support portion 210. The second coil pattern 312 may form at least one turn with reference to the core 110 on the other surface of the support portion 210.

Figure 3:
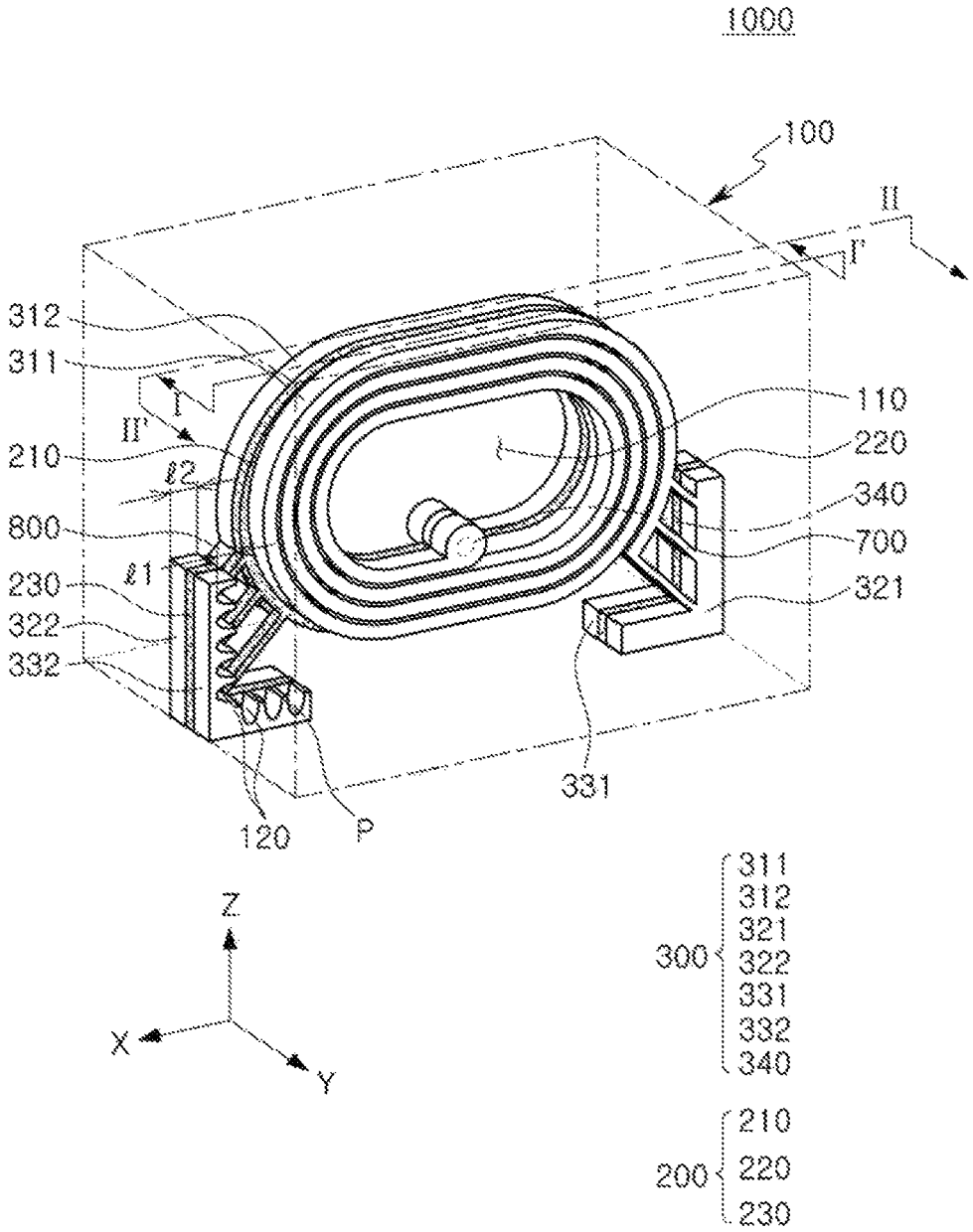
FIG. 3 is a view schematically illustrating a coil component according to a first embodiment of the present disclosure, when viewed from a side direction.

Referring to FIG. 3, the first lead-out pattern 321 may be disposed on one surface of the first end portion 220, and may extend from the first coil pattern 311 to be exposed from the one side surface 101 of the body 100 and the one surface 106 of the body 100. The second lead-out pattern 322 may be disposed on the other surface of the second end portion 230, may extend from the second coil pattern 312, and may be exposed from the other side surface 102 of the body 100 and the one surface 106 of the body 100. For example, the first and second lead-out patterns 321 and 322 may be embedded in the body 100 in an L shape overall.

The first lead-out pattern 321 may be continuously exposed from the first surface 101 and the sixth surface 106 of the body 100. The second lead-out pattern 322 may be continuously exposed from the second surface 102 and the sixth surface 106 of the body 100. When the first lead-out pattern 321 is continuously exposed from the first surface 101 and the sixth surface 106 of the body 100, a contact area with the first external electrode 500 to be described later may increase to increase the bonding force therebetween. When the second lead-out pattern 322 is continuously exposed from the second surface 102 and the sixth surface 106 of the body 100, a contact area with the second external electrode 600 to be described later may increase to increase the bonding force therebetween.

The first auxiliary lead-out pattern 331 may be disposed on the other surface of the first end portion 220 to correspond to the first lead-out pattern 321, and may be spaced apart from the second coil pattern 312. The first auxiliary lead-out pattern 331 and the first lead-out pattern 321 may be connected to each other by a connecting via (not illustrated) passing through the first end portion 220. The second auxiliary lead-out pattern 332 may be disposed on the one surface of the second end portion 230 to correspond to the second lead-out pattern 322, and may be spaced apart from the first coil pattern 311. The second auxiliary lead-out pattern 332 and the second lead-out pattern 322 may be connected to each other by a connecting via (not illustrated) passing through the second end portion 230. The reliability of bonding between the external electrodes 500 and 600 and the coil portion 300 may increase due to the first and second auxiliary lead-out patterns 331 and 332.

Since the first coil pattern 311 and the first lead-out pattern 321 may be integrally formed, no boundary therebetween may occur. Since the second coil pattern 312 and the second lead-out pattern 322 may be integrally formed, no boundary therebetween may occur. The above descriptions are merely illustrative, but the present disclosure is not limited to the case in which the above-described structures are formed at different operations to occur a boundary therebetween.

At least one of the coil patterns 311 and 312, the lead-out patterns 321 and 322, and the auxiliary lead-out patterns 331 and 332 may include at least one conductive layer.

For example, when the first coil pattern 311, the first lead-out pattern 321, the second auxiliary lead-out pattern 332, and the via 340 are formed on the one surface of the support substrate 200 by a plating process, each of the coil pattern 311, the first lead-out pattern 321, the second auxiliary lead-out pattern 332, and the via 340 may include a seed layer and an electroplating layer. The seed layer may be formed by a vapor deposition method such as an electroless plating process, a sputtering process, or the like. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is stacked on only one surface of the one electroplating layer.

The seed layer of the first coil pattern 311 and the seed layer of the via 340 may be integrally formed, no boundary therebetween may occur, but are not limited thereto. The electroplating layer of the second coil pattern 312 and the electroplating layer of the via 340 may be integrally formed, no boundary therebetween may occur, but are not limited thereto.

Each of the coil patterns 311 and 312, the lead-out patterns 321 and 322, the auxiliary lead-out patterns 331 and 332, and the via 340 may be formed of a conductive material such as copper (Cu), aluminum (Al), silver (Ag), tin (Sn), gold (Au), nickel (Ni), lead (Pb), titanium (Ti), chromium (Cr), and molybdenum (Mo), or alloys thereof, but is not limited thereto.

The insulating film 400 may be disposed between each of the support substrate 200 and the coil portion 300 and the body 100. In this embodiment, since the body 100 may include the metal magnetic powder, the insulating film 400 may be disposed between the coil portion 300 and the body 100 to insulate the coil portion 300. For example, the insulating film 400 may be formed of a thin parylene film, but is not limited thereto, and may also be formed by a spray coating method including a resin.

The insulating film 400 may be disposed between the body 100 and a region, other than regions in which the anchor portion 120 to be described later is disposed in the second auxiliary lead-out pattern 332. The anchor portion 120 may be formed, after a process of trimming a region, other than regions in which the coil portion 300 is disposed in the support substrate 200, and a process of arranging the insulating film 400 on the coil portion 300. The anchor portion 120 may be formed by filling a body, after a process of processing a portion of the second auxiliary lead-out pattern 332, and may be a YAG laser, a UV laser, a Green laser, or the like at the time of processing. As a result, as illustrated in portion A of FIG. 6, a portion of the insulating film 400 disposed on the second auxiliary lead-out pattern 332 may be processed and removed together. For example, the insulating film 400 may be disposed between the body 100 and a region, other than regions in which the anchor portion 120 is disposed in the second auxiliary lead-out pattern 332. In addition, as will be described later, since a protrusion pattern P disposed between the anchor portions 120 adjacent to each other may be not the anchor portion 120 itself, the insulating film 400 may be formed between the protrusion pattern P and the body 100.

In this embodiment, the second auxiliary lead-out pattern 332 may include an external surface exposed from a surface of the body 100, and an internal surface opposing the external surface, and the body 100 may include an anchor portion 120 formed inside the second auxiliary lead-out pattern 332. For example, the anchor portion 120 may have a form extending from the internal surface of the second auxiliary lead-out pattern 332 toward the external surface, within the range not exposed from the surface of the body 100. As illustrated in FIG. 4, the anchor portion 120 of the body 100 may be inserted into the second auxiliary lead-out pattern 332. Referring to FIG. 5, the anchor portion 120 may not be disposed in the first auxiliary lead-out pattern 331 corresponding to the first lead-out pattern 321. The first auxiliary lead-out pattern 331 may have a first external surface exposed from the one surface 106 and the one side surface 101 of the body 100, and a first internal surface opposing the first external surface. For example, the first internal surface may forma boundary between the first auxiliary lead-out pattern 331 and the body 100. The second auxiliary lead-out pattern 332 may have a second external surface exposed from the one surface 106 and the other side surface 102 of the body 100, and a second internal surface opposing the second external surface, and the anchor portion 120 may be formed on the second internal surface of the second auxiliary lead-out pattern 332. For example, the second internal surface may form a boundary between the second auxiliary lead-out pattern 332 and the body 100. Therefore, the second internal surface opposing the second external surface refers to a surface disposed in the body 100 and not exposed from a surface of the body 100, as illustrated in FIG. 3.

Referring to FIG. 3, in the thickness direction of the second auxiliary lead-out pattern 332, the anchor portion 120 may not completely pass through the second lead-out pattern 322 and the support substrate 200, and may be disposed on the support substrate 200, but may pass through only the second auxiliary lead-out pattern 332. For example, the anchor portion 120 may pass through the second auxiliary lead-out pattern 332 in the thickness direction of the second auxiliary lead-out pattern 332, and may contact the one surface of the second end portion 230.

Referring to FIG. 3, the anchor portion 120 may be formed, in plural, to be spaced apart from each other, and the second auxiliary lead-out pattern 332 may include a protrusion pattern P disposed between the anchor portions 120 adjacent to each other and may protrude inwardly in the body 100. The protrusion pattern P may be provided as a plurality of protrusion patterns P on each of the second internal surfaces connecting the plurality of anchor portions 120 adjacent to each other. For example, the anchor portion 120 may be disposed alternately with the protrusion pattern P.

As described above, the anchor portion 120 may be formed by forming a processing portion inside the second auxiliary lead-out pattern 332 using a laser, and filling a magnetic material of the body 100 therein. Due to relatively high linearity of the laser, a cross-sectional area of the second auxiliary lead-out pattern 332 may be maintained substantially constant in the thickness direction of the second auxiliary lead-out pattern 332. In addition, based on a cross-section, parallel to the one surface of the support substrate 200, the anchor portion 120 may include a curved portion recessed inwardly of the second auxiliary lead-out pattern 332. As an example, FIG. 3 illustrates that the anchor portion 120 has a semi-elliptic shape. Although not illustrated in detail, the anchor portion 120 may deform a length of the protrusion pattern (P) shorter, to form an elliptical shape connected inside the second auxiliary lead-out pattern 332, which may be suitably deformed within the range required for carrying out the present disclosure by a skilled person in the art. Referring to FIG. 3, a width (l1) of the anchor portion 120 may be 80% or less, and preferably 20% to 80% of a width (l2) of the second lead-out pattern 322. When the width (l1) of the anchor portion 120 is less than 20% of the width (l2) of the second lead-out pattern 322, a contact area between the coil portion 300 and the body 100 and a contact area between the body 100 and the support substrate 200 may not be sufficient, and thus it may be difficult to achieve the desired reliability of bonding. When the width (l1) of the anchor portion 120 exceeds 80% of the width (l2) of the second lead-out pattern 322, defects in electrical connectivity and structural stability between the lead-out patterns 321 and 322 and the auxiliary lead-out patterns 331 and 332 may occur due to excessive processing.

When the coil component 1000 of this embodiment is cut into a plane, perpendicular to the support substrate 200, the support substrate 200, the seed layer, the plating layer, and the body 100 may be arranged, in sequence, in the remaining region of the second auxiliary lead-out pattern 332, except for a region corresponding to the anchor portion 120. In addition, the anchor portion 120 may not completely pass through the second lead-out pattern 322 and the support substrate 200 in the thickness direction of the second lead-out pattern 322, which may be implemented by adjusting intensity of the laser during the processing. Due to the intensity of the laser, a surface of the support substrate 200 corresponding to the anchor portion 120 may also be partially removed. For this reason, a surface roughness of a portion removed from the surface of the second auxiliary lead-out pattern 332, and a surface roughness of a portion removed from the support substrate 200 may not be uniform. As a result, a contact area between the processing site and the body 100 may be increased to increase fixing force therebetween (an anchor portioning effect). This effect, in particular, may alleviate a boundary separation phenomenon between the body 100 and the lead-out patterns 321 and 322 according to an increase in an arrangement area of the insulating film 400, when the lead-out patterns 321 and 322 are embedded in the body 100 in an L shape. An area in which the auxiliary lead-out patterns 331 and 332 comes into contact with the magnetic material of the body 100, and an area in which the magnetic material of the body 100 comes into contact with the support substrate 200 may be compressed more firmly by the above-described series of processing and filling processes. As a result, the reliability of bonding between the body 100 and the entire coil portion 300 including the lead-out patterns 321 and 322 and the auxiliary lead-out patterns 331 and 332 may be improved.

The connecting conductors 700 and 800 may be disposed on the one surface and the other surface of the support substrate 200 to connect the lead-out patterns 321 and 322 and the coil patterns 311 and 312, respectively. Referring to FIG. 3, the first connecting conductor 700 may be disposed on the one surface of the support substrate 200 to connect the first lead-out pattern 321 and the first coil pattern 311. The second connecting conductor 800 may be disposed on the other surface of the support substrate 200 to connect the second lead-out pattern 322 and the second coil pattern 312.

Referring to FIG. 3, the first and second connecting conductors 700 and 800 may be directly connected to the first and second lead-out patterns 321 and 322, respectively, and may be spaced apart from the first and second auxiliary lead-out patterns 331 and 332 with the support substrate 200 interposed therebetween. As a result, the anchor portion 120 may be also formed inside the first and second auxiliary lead-out patterns 331 and 332, spaced apart from the first and second connecting conductors 700 and 800, with the support substrate 200 interposed therebetween.

As illustrated in FIG. 3, the first and second connecting conductors 700 and 800 may be formed, in plural, of spaced apart from each other, and the body 100 may be filled in an internal space spaced apart from each other between the connecting conductors 700 and 800. As a result, the entire bonding force between the body 100 and the coil portion 300 may be further improved, and magnetic flux area may be increased.

The external electrodes 500 and 600 may be arranged to be spaced apart from each other on the one surface 106 of the body 100, and may be connected to the first and second lead-out patterns 321 and 322. The first external electrode 500 may be connected in contact with the first lead-out pattern 321 and the first auxiliary lead-out pattern 331, and the second external electrode 600 may be connected in contact with the second lead-out pattern 322 and the second auxiliary lead-out pattern 332.

The external electrodes 500 and 600 may electrically connect the coil component 1000 to a printed circuit board and the like, when the coil component 1000 according to this embodiment is mounted on the printed circuit board and the like. For example, the coil component 1000 according to this embodiment may be mounted such that the sixth surface 106 of the body 100 faces the upper surface of the printed circuit board. Since the external electrodes 500 and 600 may be arranged to be spaced apart from each other on the sixth surface 106 of the body 100, the connection portion of the printed circuit board may be electrically connected.

The external electrodes 500 and 600 may include at least one of a conductive resin layer and an electroplating layer. The conductive resin layer may be formed by printing a conductive paste on the surface of the body 100 and curing it. The conductive paste may include any one or more conductive metals selected from the group consisting of copper (Cu), nickel (Ni), and silver (Ag), and a thermosetting resin. The electroplating layer may include any one or more selected from the group consisting of nickel (Ni), copper (Cu), and tin (Sn). In this embodiment, the external electrodes 500 and 600 may include a first layer (not illustrated) formed on the surface of the body 100 to directly contact the lead-out patterns 321 and 322 and the auxiliary lead-out patterns 331 and 332, and a second layer (not illustrated) disposed on the first layer (not illustrated), respectively. For example, the first layer (not illustrated) may be a nickel (Ni) plating layer, and the second layer (not illustrated) may be a tin (Sn) plating layer, but are not limited thereto.

Although not illustrated, the coil component 1000 according to this embodiment may further include an insulating film (not illustrated) disposed in a region, other than regions in which the external electrodes 500 and 600 among the first to sixth surfaces 101, 102, 103, 104, 105, and 106 of the body 100 are formed. The insulating film (not illustrated) may be an oxide film obtained by oxidizing a cut surface of the metal magnetic powder exposed from the first to sixth surfaces 101, 102, 103, 104, 105, and 106 of the body 100, stacking the insulating film including the insulating resin on the first to sixth surfaces 101, 102, 103, 104, 105, and 106 of the body 100, forming an insulating material on the first to sixth surfaces 101, 102, 103, 104, 105, and 106 of the body 100 by vapor deposition, or applying an insulation paste to the first to sixth surfaces 101, 102, 103, 104, 105, and 106 of the body 100 and curing it. As described above, the insulating film (not illustrated) may include a metal oxide film, or may include an insulating resin such as epoxy. The insulating film (not illustrated) may function as a plating resist in forming the external electrodes 500 and 600 by the electroplating process, but is not limited thereto.

Second Embodiment

Figure 7:
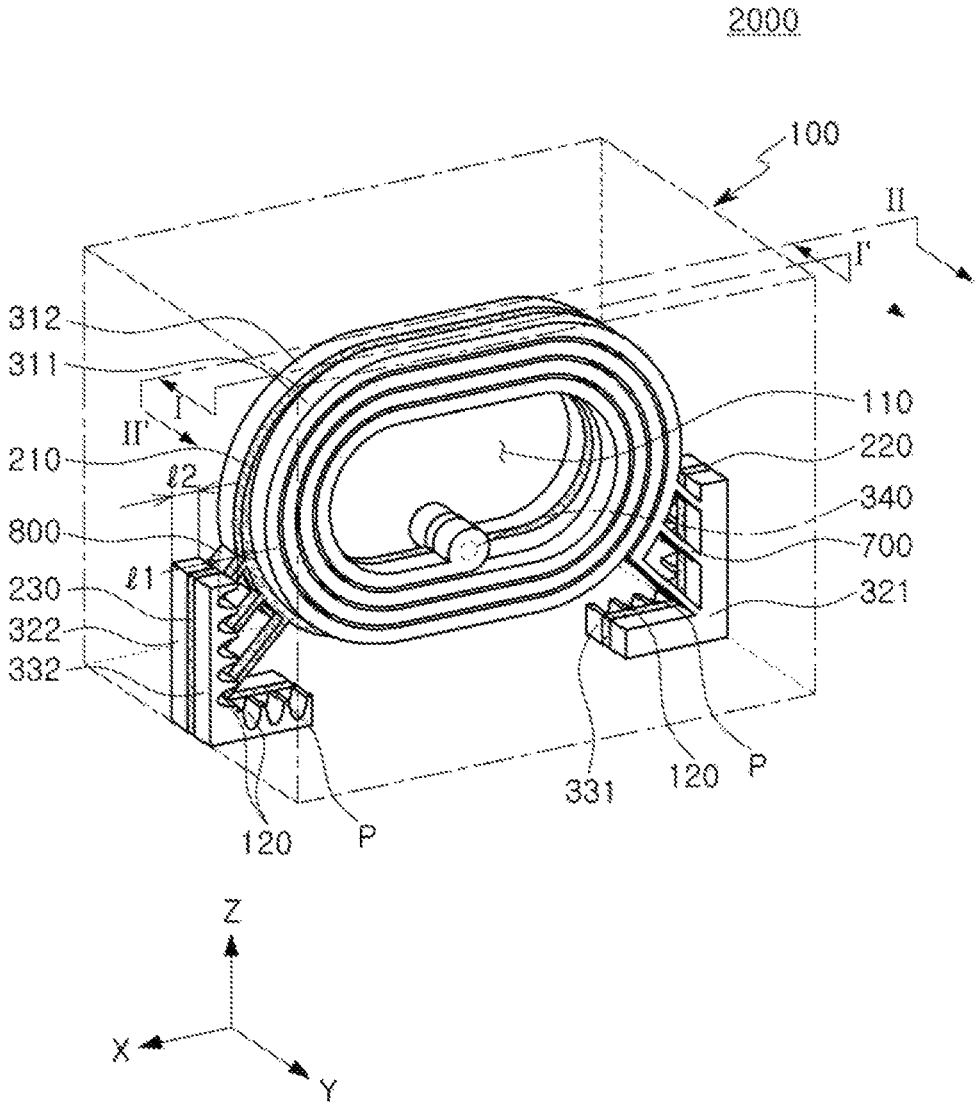
FIG. 7 is a view schematically illustrating a coil component according to a second embodiment of the present disclosure, when viewed from a side direction.
Figure 8:
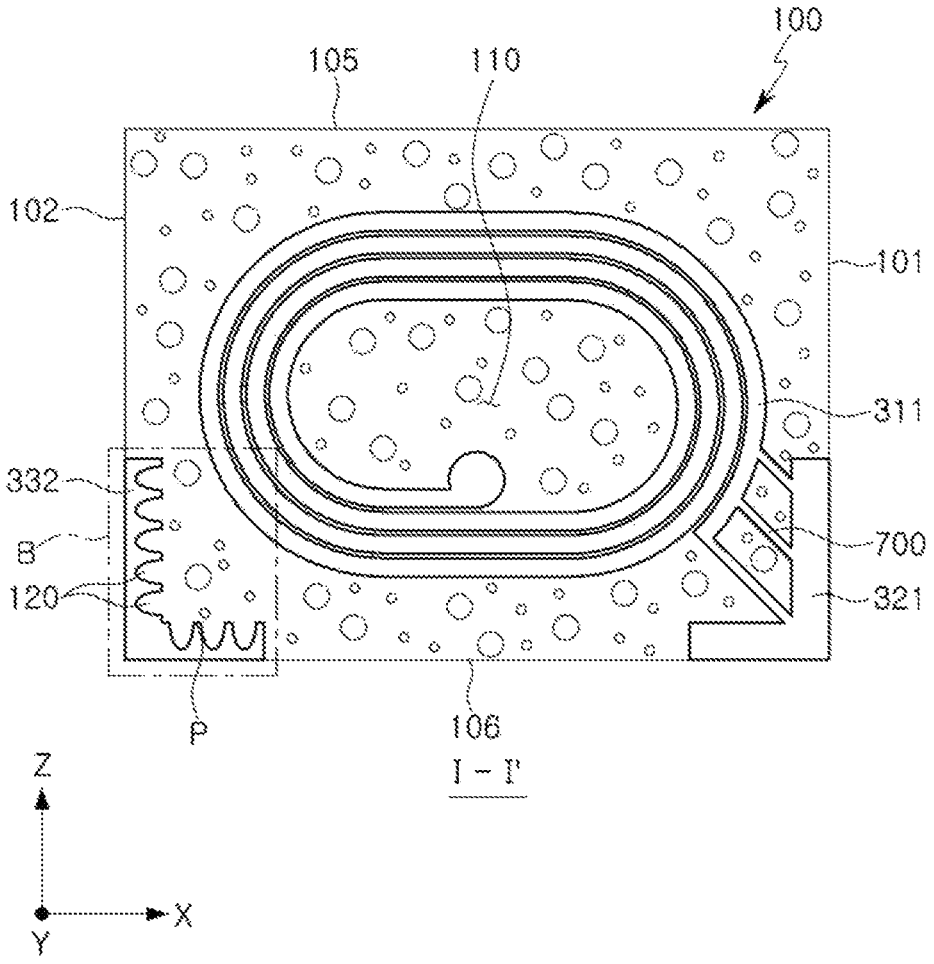
FIG. 8 is a view schematically illustrating a cross-sectional view taken along line I-I' of FIG. 7.
Figure 9:
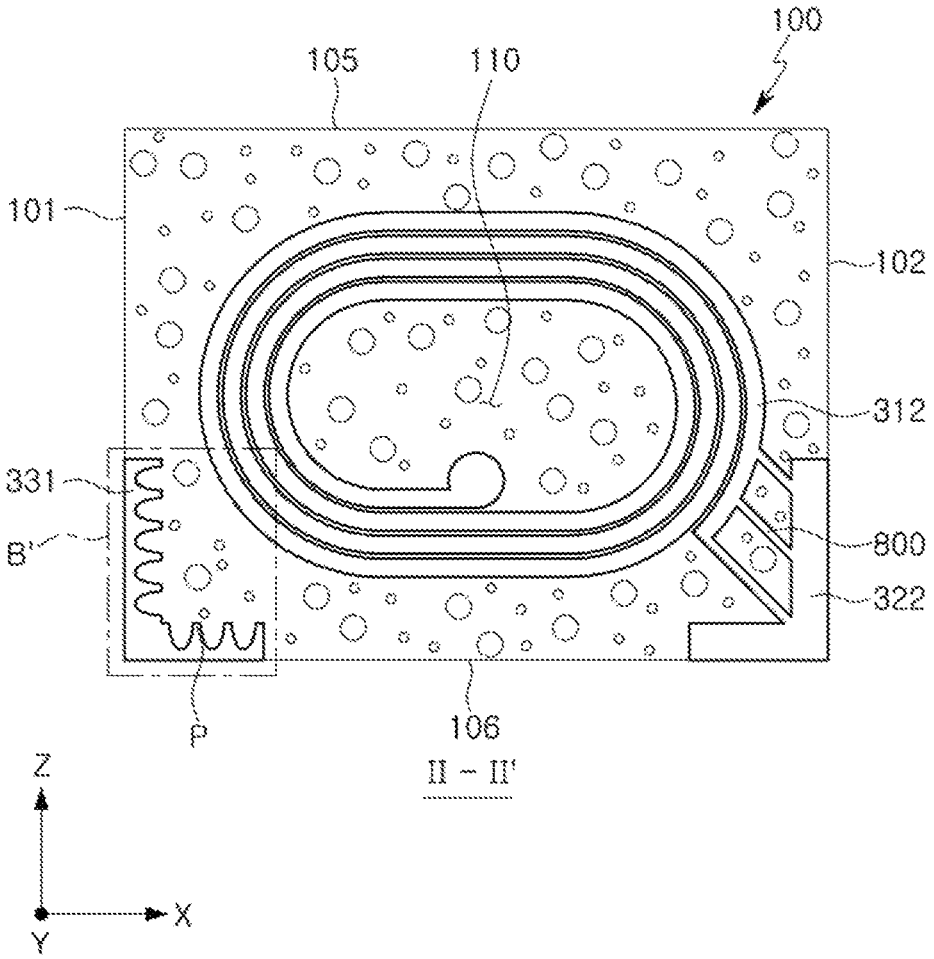
FIG. 9 is a view schematically illustrating a cross-sectional view taken along line II-II' of FIG. 7.
Figure 10:
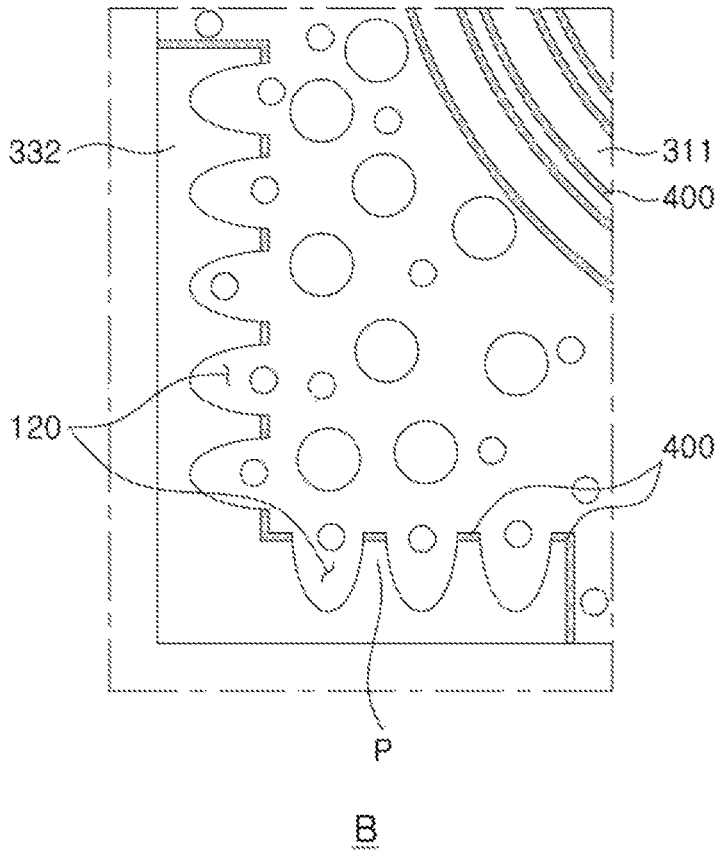
FIG. 10 is a view schematically illustrating an enlarged view of portion B of FIG. 8.
Figure 11:
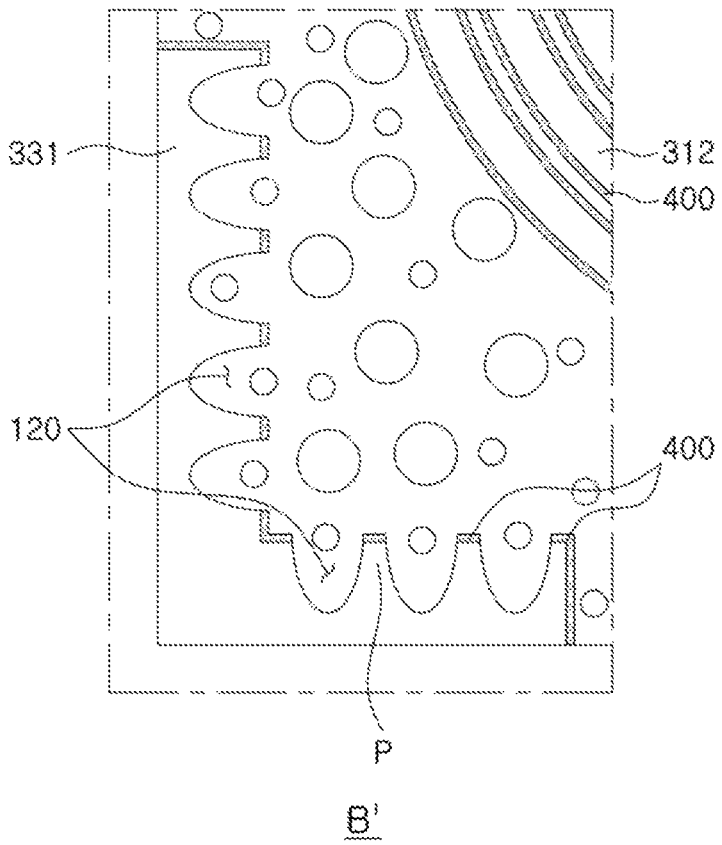
FIG. 11 is a view schematically illustrating an enlarged view of portion B' of FIG. 9.

FIG. 7 is a view schematically illustrating a coil component according to a second embodiment of the present disclosure, when viewed from a side direction. FIG. 8 is a view schematically illustrating a cross-sectional view taken along line I-I' of FIG. 7. FIG. 9 is a view schematically illustrating a cross-sectional view taken along line II-II' of FIG. 7. FIG. 10 is a view schematically illustrating an enlarged view of portion B of FIG. 8. FIG. 11 is a view schematically illustrating an enlarged view of portion B' of FIG. 9.

Comparing FIGS. 3 and 7, and FIGS. 4, 5, 8, and 9, a coil component 2000 according to this embodiment may have a different position in which an anchor portion 120 is disposed, compared to the coil component 1000 according to the first embodiment of the present disclosure. Therefore, only the position of the anchor portion 120, different from the first embodiment of the present disclosure, will be described in describing this embodiment. The remaining configuration of this embodiment may be applied as it is in the first embodiment of the present disclosure.

In this embodiment, as illustrated in FIG. 9, an anchor portion 120 of a body 100 may be inserted into a first auxiliary lead-out pattern 331 as well as a second auxiliary lead-out pattern 332. For example, referring to FIG. 9, the anchor portion 120 may be disposed in the first auxiliary lead-out pattern 331 corresponding to a first lead-out pattern 321. In this case, a first external surface of the first auxiliary lead-out pattern 331 refers to a surface exposed from the first and sixth surfaces 101 and 106 of the body 100, as illustrated in FIG. 2. Therefore, a first internal surface opposing the first external surface refers to a surface disposed in the body 100 and not exposed from the surface of the body 100, as illustrated in FIG. 7.

In this embodiment, since an area in which the anchor portion 120 is disposed may be increased, the fixing force between the body 100 and the lead-out patterns 321 and 322 and the fixing force between the body 100 and the support substrate 200 may be further improved. As a result, the reliability of bonding between the body 100 and the entire coil portion 300 including the lead-out patterns 321 and 322 and the auxiliary lead-out patterns 331 and 332 may be further improved.

Third Embodiment

Figure 12:
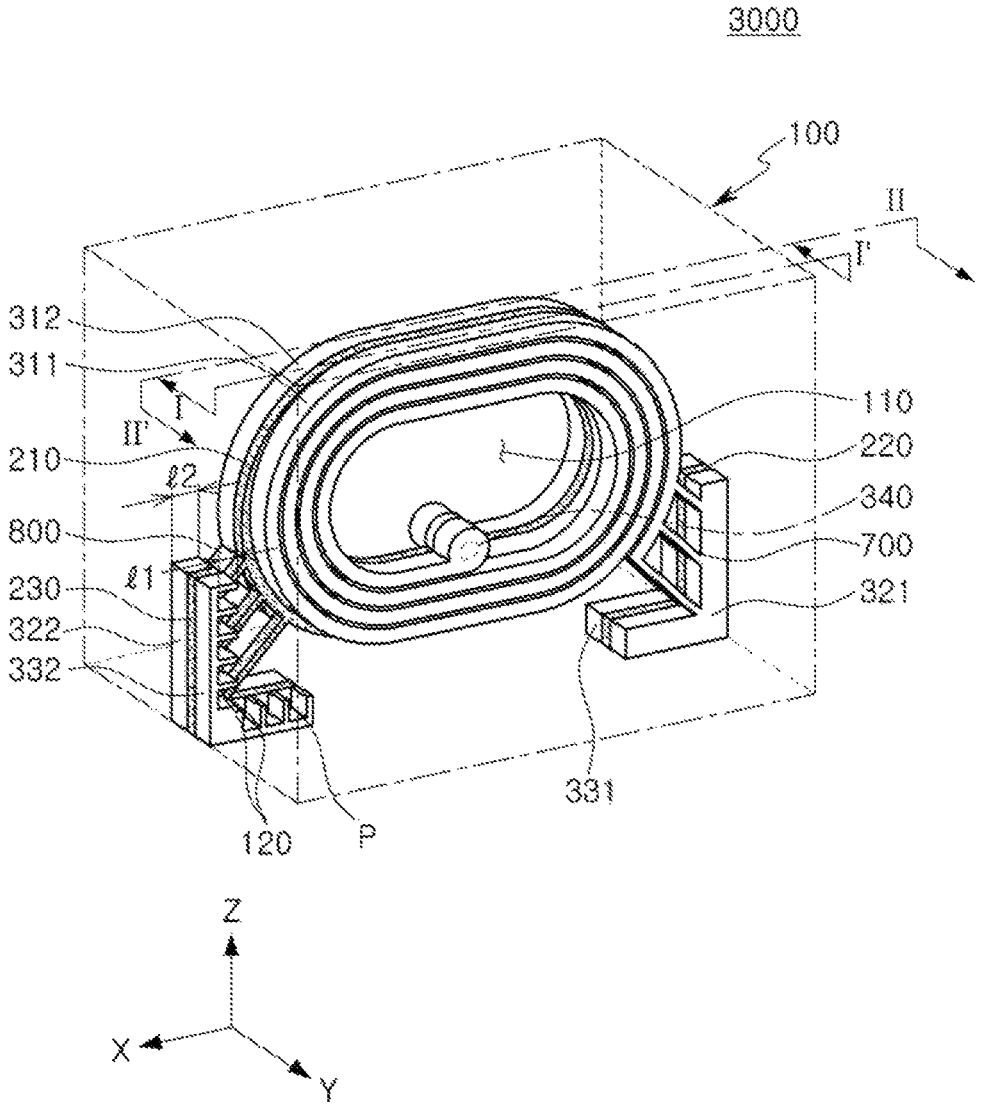
FIG. 12 is a view schematically illustrating a coil component according to a third embodiment of the present disclosure, when viewed from a side direction.
Figure 13:
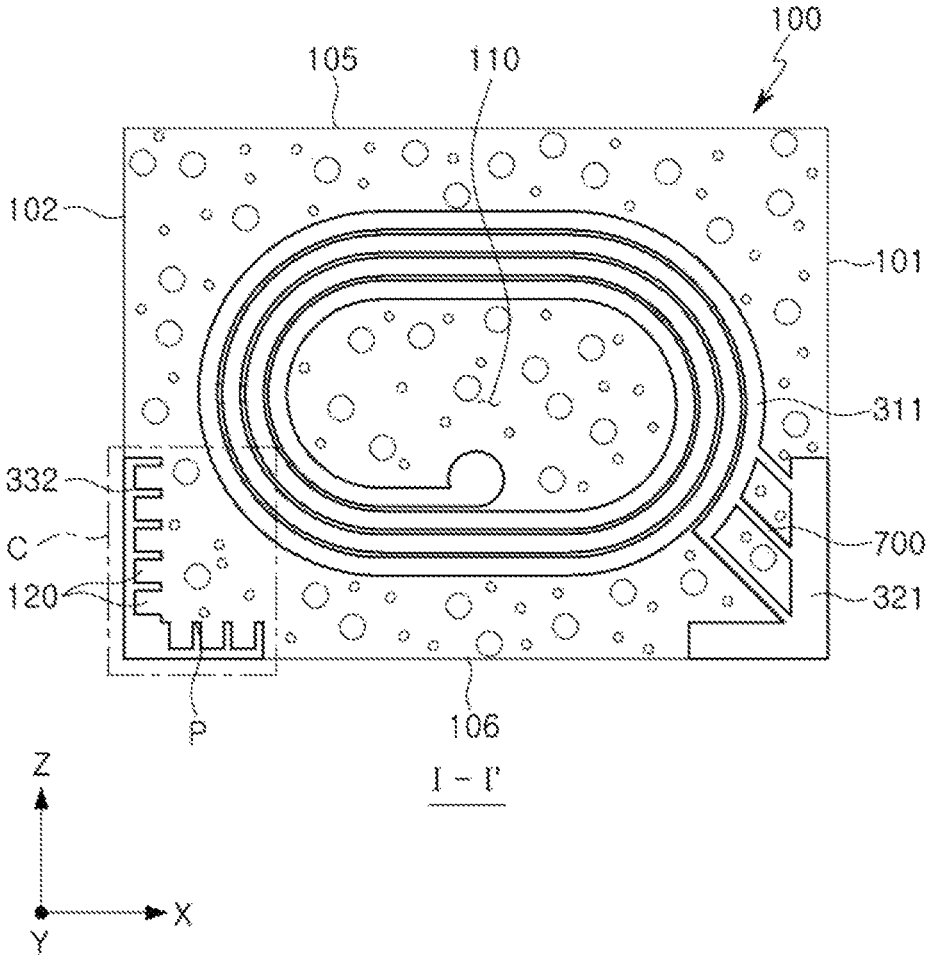
FIG. 13 is a view schematically illustrating a cross-sectional view taken along line I-I' of FIG. 12.
Figure 14:
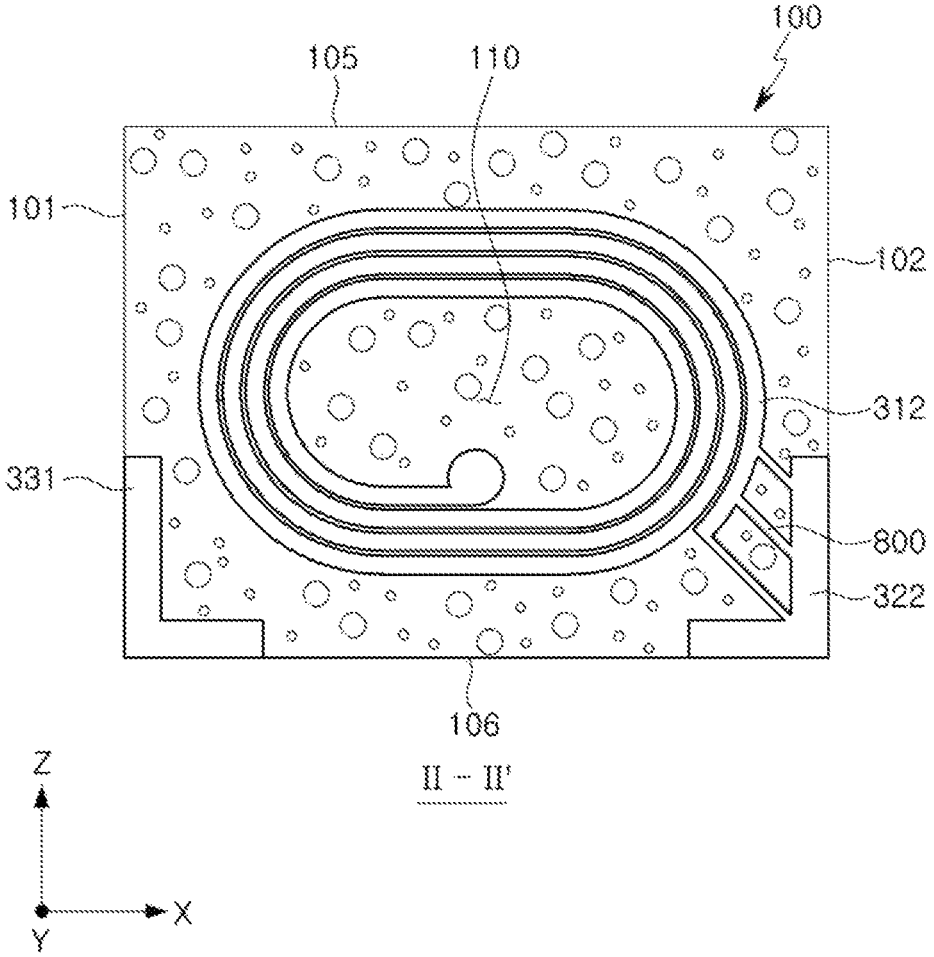
FIG. 14 is a view schematically illustrating a cross-sectional view taken along line II-II' of FIG. 12.
Figure 15:
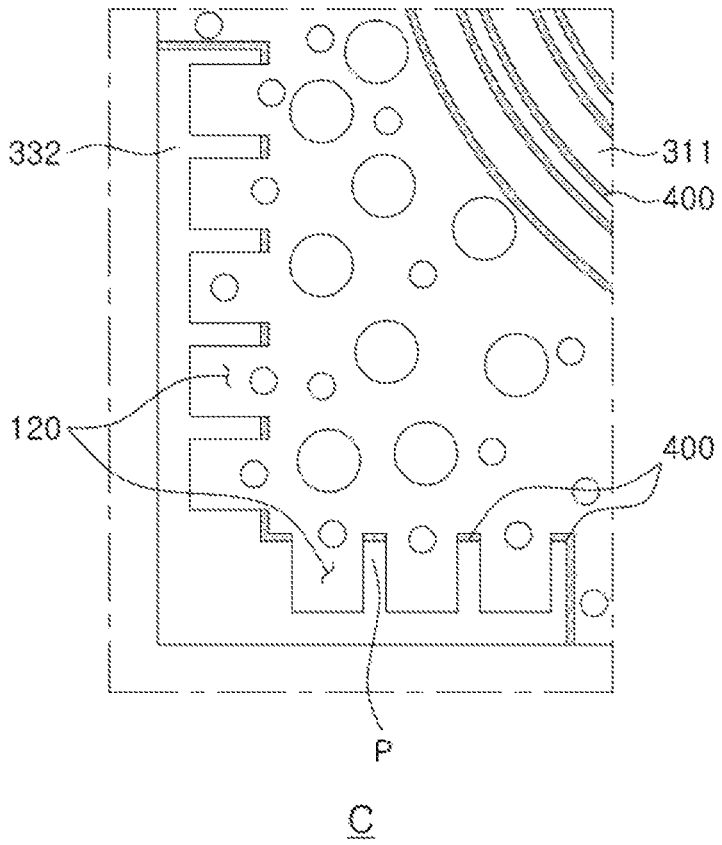
FIG. 15 is a view schematically illustrating an enlarged view of portion C of FIG. 13.

FIG. 12 is a view schematically illustrating a coil component according to a third embodiment of the present disclosure, when viewed from a side direction. FIG. 13 is a view schematically illustrating a cross-sectional view taken along line I-I' of FIG. 12. FIG. 14 is a view schematically illustrating a cross-sectional view taken along line II-II' of FIG. 12. FIG. 15 is a view schematically illustrating an enlarged view of portion C of FIG. 13.

Comparing FIGS. 3 and 12 and FIGS. 4, 5, 13, and 14, a coil component 3000 according to this embodiment may have a different shape of an anchor portion 120, compared to the coil component 1000 according to the first embodiment of the present disclosure. Therefore, only the shape of the anchor portion 120 different from the first embodiment of the present disclosure will be described in describing this embodiment. The remaining configuration of this embodiment may be applied as it is in the first embodiment of the present disclosure.

Referring to FIG. 13, the anchor portion 120 may have a polygonal shape, based on a cross-section, parallel to one surface of a support substrate 200. As an example, FIG. 13 illustrates that an anchor portion 120 and a protrusion pattern P have a rectangular shape arranged in a zigzag shape. The anchor portion 120 may have a rectangular cross-sectional shape according to the zigzag shape.

According to this embodiment, an area occupied by a second auxiliary lead-out pattern 332 in the body 100 may increase, compared to the first embodiment including the curved portion. Therefore, the electrical connection between the second auxiliary lead-out pattern 332 and a second lead-out pattern 322 may be improved while maintaining the bonding force between the body 100 and a coil portion 300.

Fourth Embodiment

Figure 16:
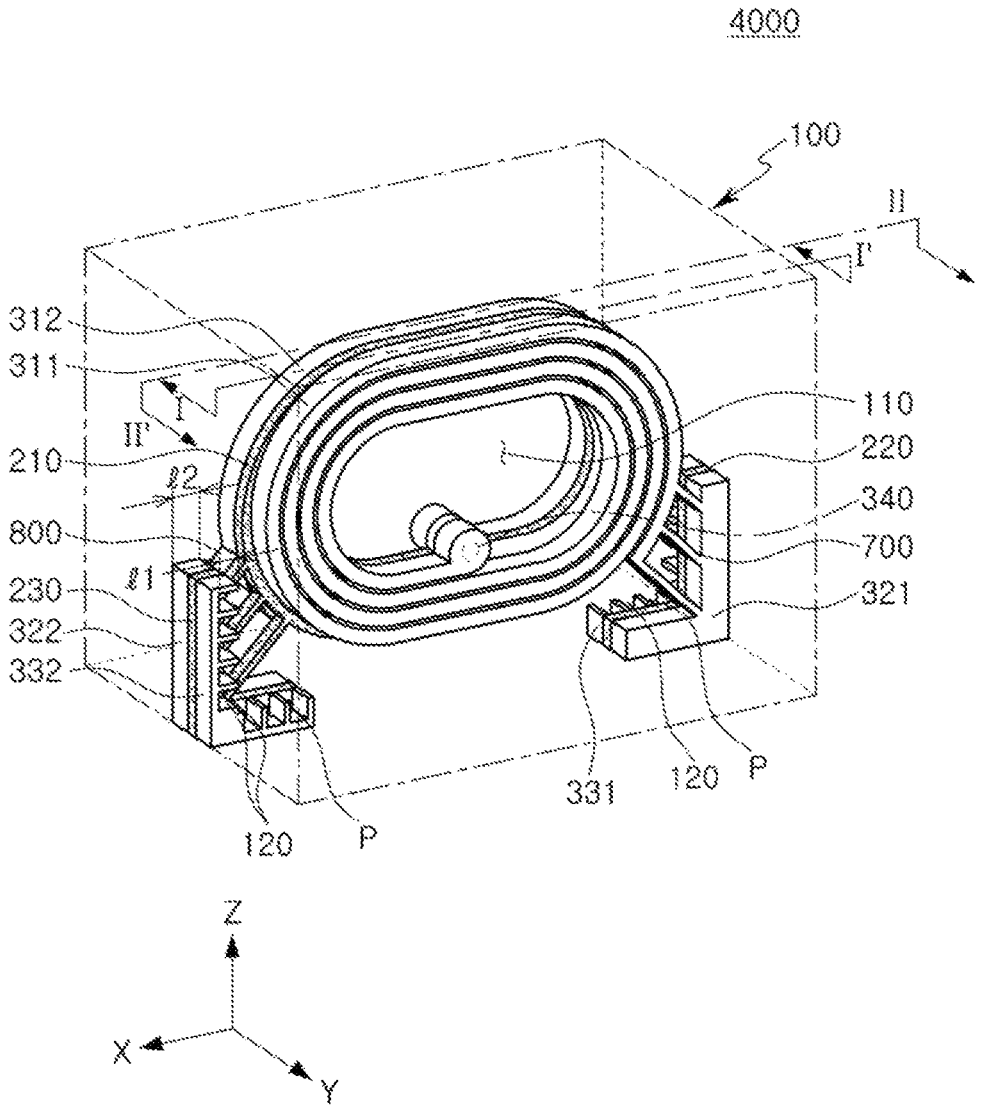
FIG. 16 is a view schematically illustrating a coil component according to a fourth embodiment of the present disclosure, when viewed from a side direction.
Figure 17:
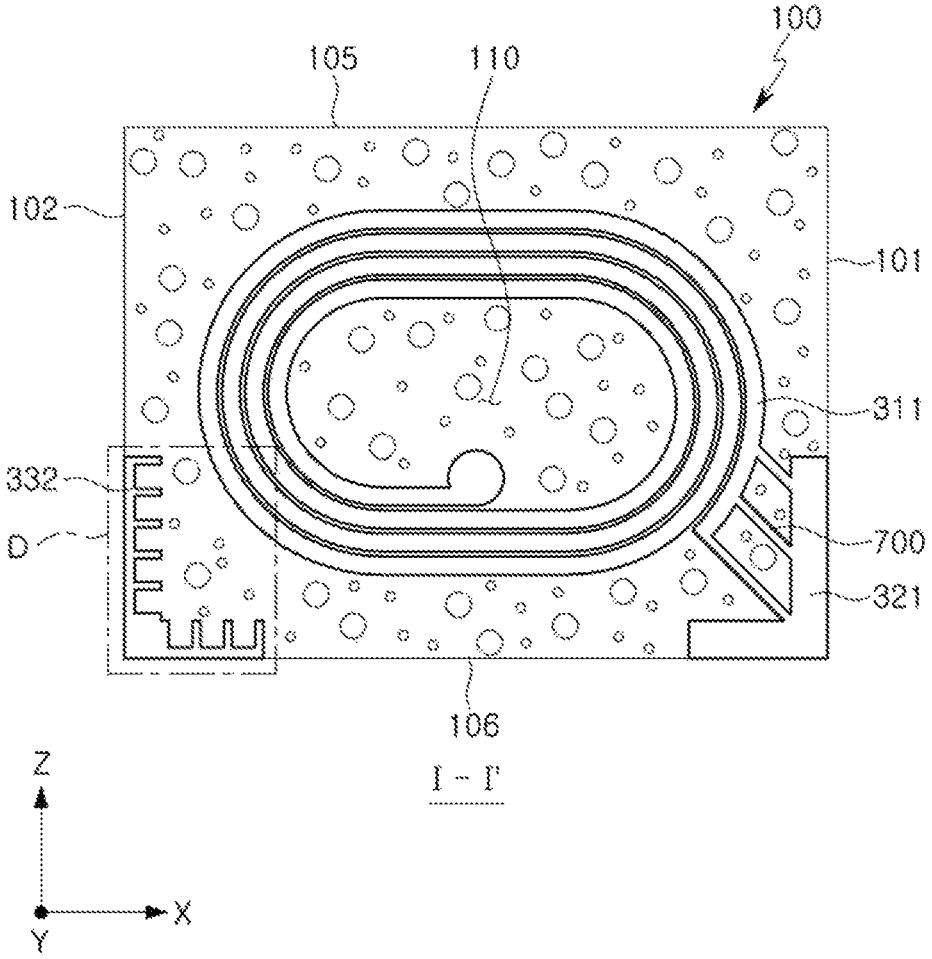
FIG. 17 is a view schematically illustrating a cross-sectional view taken along line I-I' of FIG. 16.
Figure 18:
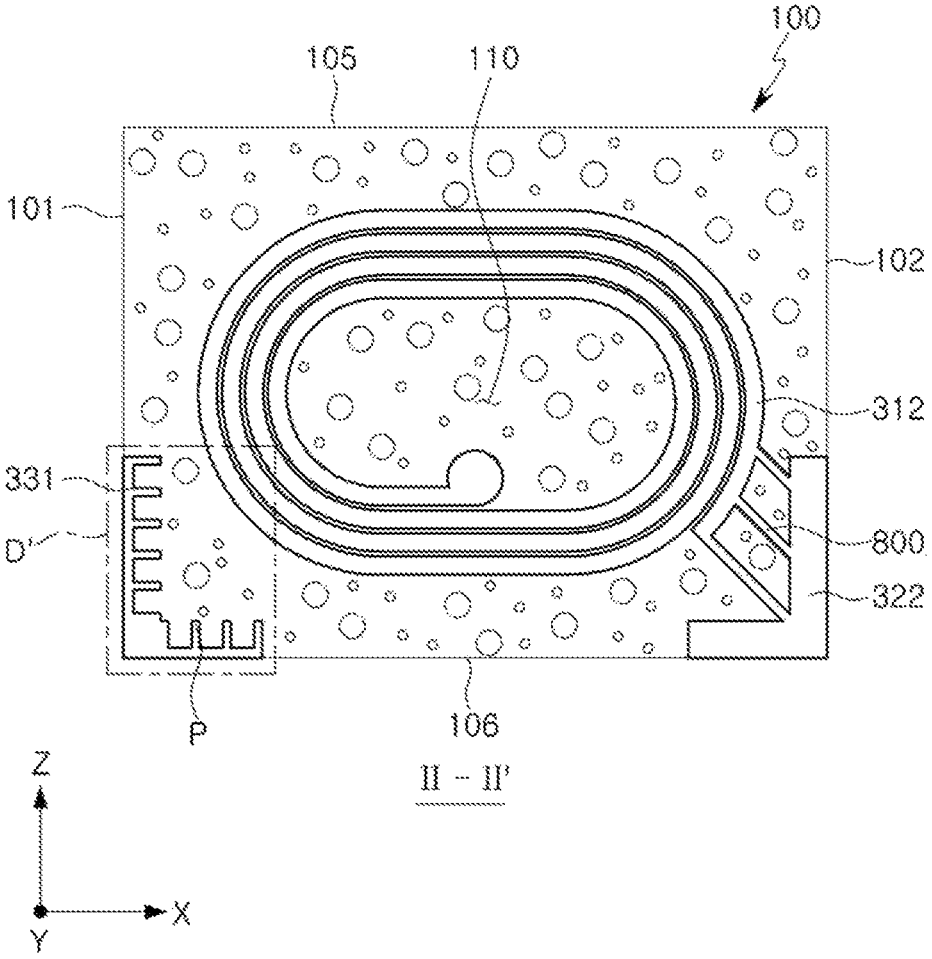
FIG. 18 is a view schematically illustrating a cross-sectional view taken along line II-II' of FIG. 16.
Figure 19:
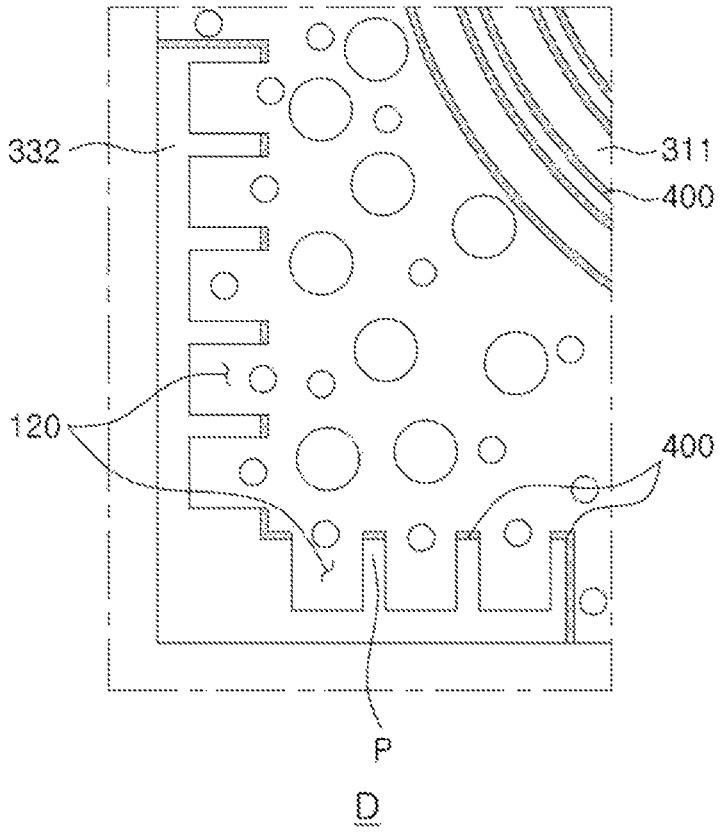
FIG. 19 is a view schematically illustrating an enlarged view of portion D of FIG. 17.
Figure 20:
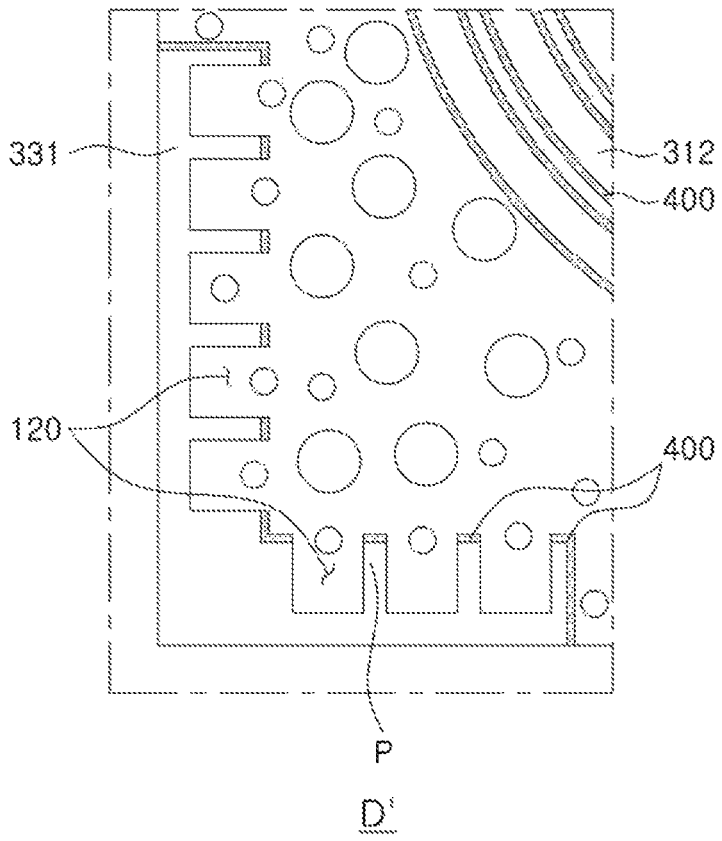
FIG. 20 is a view schematically illustrating an enlarged view of portion D' of FIG. 18.

FIG. 16 is a view schematically illustrating a coil component according to a fourth embodiment of the present disclosure, when viewed from a side direction. FIG. 17 is a view schematically illustrating a cross-sectional view taken along line I-I' of FIG. 16. FIG. 18 is a view schematically illustrating a cross-sectional view taken along line II-II' of FIG. 16. FIG. 19 is a view schematically illustrating an enlarged view of portion D of FIG. 17. FIG. 20 is a view schematically illustrating an enlarged view of portion D' of FIG. 18.

Comparing FIGS. 3 and 16, and FIGS. 4, 5, 17, and 18, a coil component 4000 according to this embodiment may have a different position in which an anchor portion 120 is disposed, compared to the coil component 3000 according to the third embodiment of the present disclosure. Therefore, only the position of the anchor portion 120 different from the third embodiment of the present disclosure will be described in describing this embodiment. The remaining configuration of this embodiment may be applied as it is in the third embodiment of the present disclosure.

In this embodiment, as illustrated in FIG. 18, an anchor portion 120 of a body 100 may be inserted into a first auxiliary lead-out pattern 331. For example, referring to FIG. 18, the anchor portion 120 may be disposed in the first auxiliary lead-out pattern 331 corresponding to a first lead-out pattern 321. In this case, a first external surface of the first auxiliary lead-out pattern 331 refers to a surface exposed from the first and sixth surfaces 101 and 106 of the body 100, as illustrated in FIG. 2. Therefore, a first internal surface opposing the first external surface refers to a surface disposed in the body 100 and not exposed from the surface of the body 100, as illustrated in FIG. 16.

In this embodiment, since an area in which the anchor portion 120 is disposed may be increased, the fixing force between the body 100 and the lead-out patterns 321 and 322 and the fixing force between the body 100 and the support substrate 200 may be further improved. As a result, the reliability of bonding between the body 100 and the entire coil portion 300 including the lead-out patterns 321 and 322 and the auxiliary lead-out patterns 331 and 332 may be further improved.

According to the present disclosure, the reliability of bonding between the coil portion and the body may be secured, and the characteristics of the coil portion may be improved.

While example embodiments have been illustrated and described above, it will be apparent to those skilled in the art that modifications and variations could be made without departing from the scope of the present disclosure as defined by the appended claims.

What is claimed is:

1. A coil component comprising:

a body;

a substrate embedded in the body;

a coil portion disposed on the substrate and embedded in the body, and including a lead-out pattern disposed on one surface of the substrate, and an auxiliary lead-out pattern disposed on another surface of the substrate and corresponding to the lead-out pattern; and an insulating film disposed between the coil portion and the body and between the substrate and the body, wherein the auxiliary lead-out pattern comprises an external surface extending on a surface of the body, and an internal surface opposing the external surface, the body comprises an anchor portion disposed inside the auxiliary lead-out pattern, and the insulating film is disposed between the body and a region of the auxiliary lead-out pattern, other than a region in which the anchor portion is disposed.

2. The coil component according to claim 1, wherein the auxiliary lead-out pattern comprises a protrusion pattern disposed between the auxiliary lead-out pattern and the anchor portion adjacent to the auxiliary lead-out pattern and protruding inwardly of the body, wherein the insulating film is disposed between the protrusion pattern and the body.

3. The coil component according to claim 1, wherein the anchor portion includes a plurality of portions spaced apart from each other.

4. The coil component according to claim 1, wherein the auxiliary lead-out pattern has a substantially constant cross-sectional area in a direction along which the auxiliary lead-out pattern is disposed on the substrate.

5. The coil component according to claim 1, wherein the anchor portion does not completely pass through the lead-out pattern and the substrate in a thickness direction of the lead-out pattern.

6. The coil component according to claim 1, wherein the anchor portion comprises a curved portion recessed inwardly of the auxiliary lead-out pattern, based on a cross-section, parallel to the one surface of the substrate.

7. The coil component according to claim 1, wherein the anchor portion comprises a polygonal shape, based on a cross-section, parallel to the one surface of the substrate.

8. The coil component according to claim 1, wherein a width of the anchor portion is 80% or less of a width of the lead-out pattern.

9. The coil component according to claim 1, wherein the coil portion comprises:

a first coil pattern disposed on the one surface of the substrate; and a second coil pattern disposed on the another surface of the substrate, the lead-out pattern comprises:

a first lead-out pattern disposed on the one surface of the substrate and connected to the first coil pattern; and a second lead-out pattern disposed on the another surface of the substrate and connected to the second coil pattern, and the auxiliary lead-out pattern comprises:

a first auxiliary lead-out pattern disposed on the another surface of the substrate to correspond to the first lead-out pattern; and a second auxiliary lead-out pattern disposed on the one surface of the substrate to correspond to the second lead-out pattern.

10. The coil component according to claim 9, wherein the body comprises one surface, and one side surface and another side surface respectively connected to the one surface and opposing each other, wherein the first lead-out pattern and the first auxiliary lead-out pattern extend from the one surface and the one side surface of the body, and the second lead-out pattern and the second auxiliary lead-out pattern extend from the one surface and the another side surface of the body.

11. The coil component according to claim 9, further comprising a first connecting conductor disposed on the one surface of the substrate and connecting the first lead-out pattern and the first coil pattern; and a second connecting conductor disposed on the another surface of the substrate and connecting the second lead-out pattern and the second coil pattern, wherein the anchor portion is disposed inside of the first and second auxiliary lead-out patterns respectively spaced apart from the first and second connecting conductors with the substrate interposed therebetween.

12. The coil component according to claim 10, wherein the first auxiliary lead-out pattern has a first external surface extending from the one surface of the body and the one side surface of the body, and a first internal surface opposing the first external surface, and the second auxiliary lead-out pattern has a second external surface extending from the one surface of the body and the another side surface of the body, and a second internal surface opposing the second external surface, wherein the anchor portion is disposed in the body adjacent to the first and second internal surfaces of the first and second auxiliary lead-out patterns, and the first and second internal surfaces are boundaries between the first and second auxiliary lead-out patterns and the body, respectively.

13. The coil component according to claim 12, wherein the first external surface is continuously disposed on the one surface of the body and one side surface of the body, and the second external surface is continuously disposed on the one surface of the body and the another side surface of the body.

14. The coil component according to claim 1, further comprising an external electrode connected to the lead-out pattern and the auxiliary lead-out pattern, wherein the anchor portion is spaced apart from the external electrode.

15. The coil component according to claim 1, wherein, among the lead-out pattern and the auxiliary lead-out pattern, the anchor portion is disposed only inside the auxiliary lead-out pattern.

16. The coil component according to claim 1, wherein the body including the anchor portion is composed of a magnetic material.

17. A coil component comprising:

a body;

a coil portion embedded in the body; and a substrate including a support portion supporting the coil portion and an end portion supporting a lead-out portion, wherein the coil portion comprises the lead-out portion extending from the coil portion and disposed on one surface of the end portion and an auxiliary lead-out portion disposed on another surface of the end portion to correspond to the lead-out portion, the body comprises an anchor portion disposed inside the auxiliary lead-out portion, and among the lead-out pattern and the auxiliary lead-out pattern, the anchor portion is disposed only inside the auxiliary lead-out portion.

18. The coil component according to claim 17, further comprising an external electrode connected to the lead-out pattern and the auxiliary lead-out portion, wherein the anchor portion is spaced apart from the external electrode.

* * * * *